US010504454B2

(12) United States Patent
Nishimura et al.

(10) Patent No.: US 10,504,454 B2
(45) Date of Patent: Dec. 10, 2019

(54) SCAN LINE DRIVE CIRCUIT, DISPLAY DRIVER, ELECTRO-OPTICAL APPARATUS, ELECTRONIC DEVICE, AND DRIVING METHOD

(71) Applicant: SEIKO EPSON CORPORATION, Tokyo (JP)

(72) Inventors: Motoaki Nishimura, Chino (JP); Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/712,556

(22) Filed: Sep. 22, 2017

(65) Prior Publication Data

US 2018/0090081 A1 Mar. 29, 2018

(30) Foreign Application Priority Data

Sep. 26, 2016 (JP) ..... 2016-186649

(51) Int. Cl.

| | |
|---|---|
| ***G09G 3/34*** | (2006.01) |
| ***G09G 3/20*** | (2006.01) |
| ***G09G 3/30*** | (2006.01) |
| ***G09G 3/3266*** | (2016.01) |
| ***G09G 3/36*** | (2006.01) |

(52) U.S. Cl.

CPC ..... *G09G 3/3413* (2013.01); *G09G 3/2003* (2013.01); *G09G 3/2092* (2013.01); *G09G 3/30* (2013.01); *G09G 3/3266* (2013.01); *G09G 3/3677* (2013.01); *G09G 2310/0264* (2013.01); *G09G 2310/0267* (2013.01); *G09G 2320/0219* (2013.01); *G09G 2320/0223* (2013.01)

(58) Field of Classification Search

CPC .. G09G 3/3413; G09G 3/2003; G09G 3/2092; G09G 3/30; G09G 2310/0264

See application file for complete search history.

(56) References Cited

U.S. PATENT DOCUMENTS

| | | | | |
|---|---|---|---|---|
| 6,191,769 | B1 * | 2/2001 | Fujiwara | G09G 3/3648 345/94 |
| 7,586,476 | B2 * | 9/2009 | Kwon | G09G 3/3614 345/100 |
| 8,199,099 | B2 * | 6/2012 | Kwon | G09G 3/3614 345/100 |
| 8,362,999 | B2 * | 1/2013 | Huang | G09G 3/3648 345/100 |

(Continued)

FOREIGN PATENT DOCUMENTS

JP 2006-350289 A 12/2006

*Primary Examiner* — Peter D McLoone

(74) *Attorney, Agent, or Firm* — Oliff PLC

(57) ABSTRACT

The scan line drive circuit outputs selection signals GV3 and GV4 to select scan lines in the display panel. Assuming that a period in which a data voltage SV1 after being subjected to inversion of the polarity thereof is supplied to a data line in the display panel is a first period TSD, and that a period in which the data voltage SV1 after not being subjected to inversion of the polarity thereof is supplied to the data line is a second period TSC, the period TPD from the start of the first period TSD until the selection signal GV4 is activated is longer than the period TPC from the start of the second period TSC until the selection signal GV3 is activated.

17 Claims, 13 Drawing Sheets

(56) References Cited

U.S. PATENT DOCUMENTS

| | | | | |
|---|---|---|---|---|
| 8,427,413 | B2 * | 4/2013 | Kitayama | G09G 3/36 345/100 |
| 8,451,205 | B2 * | 5/2013 | Kitayama | G09G 3/3614 345/100 |
| 8,698,724 | B2 * | 4/2014 | Kitayama | G09G 3/36 345/100 |
| 9,865,217 | B2 * | 1/2018 | Won | G09G 3/3685 |
| 2006/0232538 | A1 * | 10/2006 | Kobashi | G09G 3/3614 345/94 |
| 2006/0284815 | A1 * | 12/2006 | Kwon | G09G 3/3614 345/98 |
| 2008/0136764 | A1 * | 6/2008 | Kim | G09G 3/3614 345/92 |
| 2009/0085860 | A1 * | 4/2009 | Huang | G09G 3/3648 345/102 |
| 2009/0295784 | A1 * | 12/2009 | Kwon | G09G 3/3614 345/213 |
| 2010/0097367 | A1 * | 4/2010 | Kitayama | G09G 3/3614 345/213 |
| 2010/0118013 | A1 * | 5/2010 | Kitayama | G09G 3/3614 345/211 |
| 2012/0169687 | A1 * | 7/2012 | Huang | G09G 3/3614 345/208 |
| 2013/0235025 | A1 * | 9/2013 | Kitayama | G09G 3/3614 345/214 |
| 2015/0035740 | A1 * | 2/2015 | Gondo | G09G 3/3614 345/96 |
| 2015/0302816 | A1 * | 10/2015 | Won | G09G 3/3685 345/87 |
| 2016/0379579 | A1 * | 12/2016 | Cho | G09G 3/3275 345/214 |
| 2017/0132982 | A1 * | 5/2017 | Zhang | G09G 3/3614 |

* cited by examiner

SCAN LINE DRIVE CIRCUIT, DISPLAY DRIVER, ELECTRO-OPTICAL APPARATUS, ELECTRONIC DEVICE, AND DRIVING METHOD

This application claims the benefit of Japanese Patent Application No. 2016-186649, filed on Sep. 26, 2016. The content of the aforementioned application is hereby incorporated herein by reference in its entirety.

BACKGROUND

1. Technical Field

The present invention relates to a scan line drive circuit, a display driver, an electro-optical apparatus, an electronic device, a driving method, and the like.

2. Related Art

Display panels having a so-called dual gate structure are known as a kind of display panel used in active matrix display devices. In a display panel having a dual gate structure, a pixel selected by a first scan line and a pixel selected by a second scan line are on the same display line (a display line in a horizontal scan direction), and these two pixels share a single data line.

For example, JP-A-2006-350289 discloses a known technique to drive the display panel having a dual gate structure. In JP-A-2006-350289, dot inversion driving is performed so that pixels that are adjacent to each other in the horizontal scan direction are driven with opposite polarities. The period in which a scan line is selected when driving a pixel after the polarity of a data voltage has been inverted is set longer than the period in which a scan line is selected when driving a pixel after the polarity of the data voltage has not been inverted.

In the case of performing dot inversion driving in a display panel having a dual gate structure, when a selected scan line changes, there are cases where the polarity of the data voltage supplied to the data line is inverted, as well as case where the polarity is not inverted. For example, when the first, second, third, and fourth scan lines are selected, data voltages of positive polarity, negative polarity, negative polarity, and positive polarity are supplied to respective data lines. In this case, the polarity of the data voltage is inverted when the second scan line is selected, and the polarity of the data voltage is not inverted when the third scan line is selected.

If the polarity of the data voltage has been inverted, a voltage change in the data voltage increases. Accordingly, the charging of capacitance on the data lines and the pixels takes more time than in the case where the polarity of the data voltage has not been inverted. For this reason, there is a possibility that the data voltage is not sufficiently written to the pixels after the polarity of the data voltage has been inverted, and display quality may be degraded (e.g. vertical noise occurs) accordingly. Note that this applies not only to the display panel having a dual gate structure. The same problem may occur if there are cases where the polarity of the data voltage supplied to a data line is inverted and the cases where the polarity is not inverted, when the selected scan line changes.

In the aforementioned JP-A-2006-350289, the insufficient writing is complemented by making a pixel charging period after the polarity of the data voltage has been inverted longer than a pixel charging period after the polarity of the data voltage has not been inverted. However, it is desirable that the data voltage is written to the pixels under the same conditions as much as possible. For example, after the polarity of the data voltage has been inverted, the time taken for the voltage of the data voltage settles is longer than that after the polarity of the data voltage has not been inverted. For this reason, the settling state of the data voltage at the timing at which a scan line was selected after the polarity of the data voltage has been inverted differs from that after the polarity of the data voltage has not been inverted. In terms of display quality, it is desirable that such differences in conditions do not occur as much as possible.

SUMMARY

In some aspects of the invention, it is possible to provide a scan line drive circuit, a display driver, an electro-optical apparatus, an electronic device, a driving method, and the like that are capable of increasing display quality when inversion driving is performed in a display panel. An aspect of the invention concerns a scan line drive circuit that outputs a selection signal to select a scan line in a display panel, wherein, assuming that a period in which a data voltage after being subjected to inversion of a polarity thereof is supplied to a data line in the display panel is a first period, and that a period in which the data voltage after not being subjected to inversion of the polarity thereof is supplied to a data line is a second period, a period from a start of the first period until the selection signal is activated is longer than a period from a start of the second period until the selection signal is activated.

According to an aspect of the invention, the selection signal is output so that the period from the start of the first period in which the data voltage after being subjected to polarity inversion is supplied until the selection signal is activated is longer than the period from the start of the second period in which the data voltage after not being subjected to polarity inversion is supplied until the selection signal is activated. With this configuration, the settling state of the data voltage at the timing at which the scan line is selected can be equalized after the polarity on the data line has been inverted and after the polarity on the data line has not been inverted. Then, a desired voltage can be written to a pixel until the selection signal is inactivated. Thus, display quality can be increased in the case of performing dot inversion driving in the display panel having a dual gate structure or the like.

In an aspect of the invention, a length of a first selection period in which the selection signal is maintained in an active state within the first period may be the same as a length of a second selection period in which the selection signal is maintained in an active state within the second period.

Due to the same length of the first selection period and the second selection period, the time taken from when the first period starts until the first selection period ends is longer than the time taken from when the second period starts until the second selection period ends. With this configuration, the time taken until the selection period ends is extended in the case where the polarity has been inverted and the settling of the data voltage takes time, and the pixel can be charged to the same degree as in the case where the polarity has not been inverted.

In an aspect of the invention, the first period may be a period after the polarity of the data voltage has been inverted due to switching from a first common voltage, which is higher than the data voltage, to a second common voltage, which is lower than the data voltage, or due to switching from the second common voltage to the first common voltage.

According to an aspect of the invention, the polarity of the data voltage is changed by switching between the first common voltage and the second common voltage. A difference occurs in the settling time of the data voltage between the case after the polarity of the data voltage has not been inverted and the case after the polarity has been inverted. According to an aspect of the invention, the difference in the settling time can be handled by differentiating the time from the start of output of the data voltage until the selection signal is activated.

In an aspect of the invention, the display panel may be a display panel having a first pixel group to be selected by a first scan line and a second pixel group to be selected by a second scan line, the first scan line and the second scan line being provided corresponding to a first display line, and the data line may be shared by a pixel in the first pixel group and a pixel in the second pixel group.

When performing dot inversion driving in such a display panel, there are cases where the polarity of the data voltage is inverted and cases where the polarity of the data voltage is not inverted, between a certain pixel and the next pixel. For this reason, a difference occurs in the settling time of the data voltage between the case after the polarity of the data voltage has not been inverted and the case after the polarity has been inverted. According to an aspect of the invention, the difference in the settling time can be handled by differentiating the time from the start of output of the data voltage until the selection signal is activated.

In an aspect of the invention, the selection signal to select the first scan line may be activated to select the first pixel group in a third period in which the data voltage having the same polarity as the polarity of the data voltage to drive the first pixel group is supplied to the data line, and in a fourth period in which the data voltage to drive the first pixel group is supplied to the data line. The selection signal to select the second scan line may be activated to select the second pixel group in a fifth period in which the data voltage having the same polarity as the polarity of the data voltage to drive the second pixel group is supplied to the data line, and in a sixth period in which the data voltage to drive the second pixel group is supplied to the data line. If the fourth period or the sixth period is a period after the polarity of the data voltage has been inverted, a period from a start of the fourth period or the sixth period after the polarity of the data voltage has been inverted until the selection signal is activated may be longer than a period from a start of the period in which the data voltage after not being subjected to inversion of the polarity thereof is supplied to the data line until the selection signal is activated.

According to an aspect of the invention, when writing is performed to a pixel having the same polarity as that of pixels in the first pixel group, the pixels in the first pixel group are pre-driven, and writing to the pixels in the first pixel group is performed when the data voltages of the pixels in the first pixel group are supplied. When writing is performed to a pixel having the same polarity as that of pixels in the second pixel group, the pixels in the second pixel group are pre-driven, and writing to the pixels in the second pixel group is performed when the data voltages of the pixels in the second pixel group are supplied. When such double-on driving is performed, if the writing to the pixels in the first pixel group or the pixels in the second pixel group is performed after the polarity of the data voltage has been inverted, the period from the start of the period in which this data voltage is supplied until the selection signal is activated is longer than the period from the start of the period in which the data voltage after not being subjected to polarity inversion is supplied until the selection signal is activated. Thus, the display quality during double-on driving can be increased.

In an aspect of the invention, if the third period or the fifth period is a period after the polarity of the data voltage has been inverted, a period from a start of the third period or the fifth period after the polarity of the data voltage has been inverted until the selection signal is activated may be longer than a period from a start of the period in which the data voltage after not being subjected to inversion of the polarity thereof is supplied to the data line until the selection signal is activated.

When such double-on driving is performed, if pre-driving of the pixels in the first pixel group or the pixels in the second pixel group is performed after the polarity of the data voltage has been inverted, the period from the start of the period in which this data voltage is supplied until the selection signal is activated is longer than the period from the start of the period in which the data voltage after not being subjected to polarity inversion is supplied until the selection signal is activated. Thus, the display quality during double-on driving is likely to be further increased.

In an aspect of the invention, the display panel may have a pixel on a first display line to be selected by a first scan line, a pixel on a second display line to be selected by a second scan line, and a pixel on a third display line to be selected by a third scan line. The pixel on the first display line, the pixel on the second display line, and the pixel on the third display line may be pixels having colors different from one another.

It is conceivable that, in the display panel having such a triple gate structure, driving is performed so that the polarity of the data voltage is inverted at every several display lines. When such driving is performed, there are cases where the polarity of the data voltage is inverted and cases where the polarity of the data voltage is not inverted, between a certain pixel and the next pixel. For this reason, a difference occurs in the settling time of the data voltage between the case after the polarity of the data voltage has not been inverted and the case after the polarity has been inverted. According to an aspect of the invention, the difference in the settling time can be handled by differentiating the time from the start of output of the data voltage until the selection signal is activated.

Another aspect of the invention concerns a display driver that includes any one of the above-described scan line drive circuits, and a data line drive circuit that drives the data line.

Yet another aspect of the invention concerns an electro-optical apparatus including any one of the above-described scan line drive circuits, and the display panel.

Yet another aspect of the invention concerns an electronic device including any one of the above-described scan line drive circuits.

Yet another aspect of the invention concerns a driving method for outputting a selection signal to select a scan line in a display panel, comprising: outputting the selection signal so that a period from a start of a first period in which a data voltage after being subjected to inversion of a polarity thereof is supplied to a data line in the display panel until the selection signal is activated is longer than a period from a start of a second period in which the data voltage after not being subjected to inversion of the polarity thereof is supplied to the data line until the selection signal is activated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferable embodiment of the invention will be described in detail. Note that the embodiment described below does not intend to unduly limit the content of the invention described in the patent claims, and not all configurations described in this embodiment are necessarily essential for solving means of the invention.

1. Scan Line Drive Circuit and Display Driver

Figure 1:
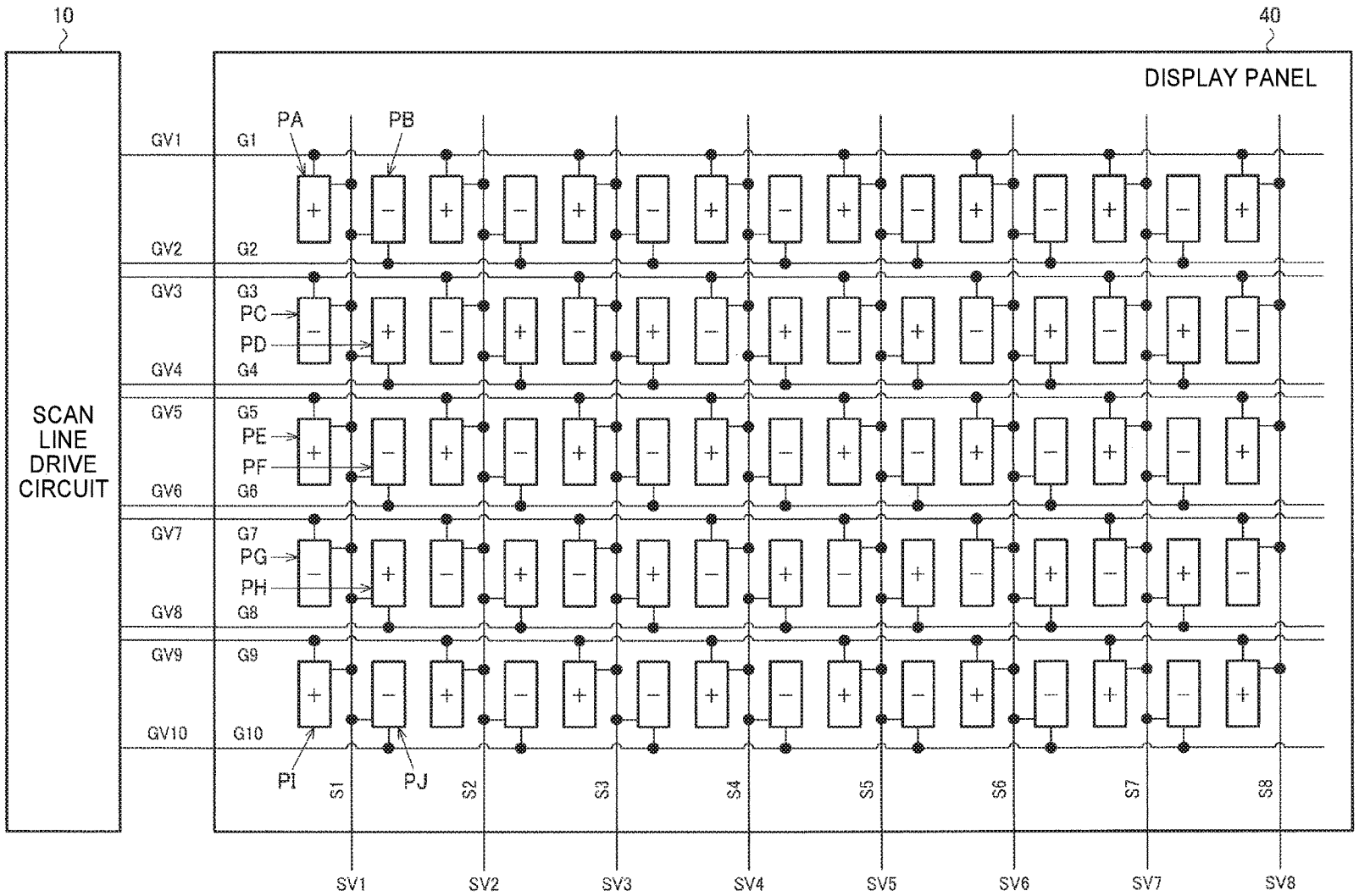
FIG. 1 shows an exemplary configuration of connection between a scan line drive circuit and a display panel according to this embodiment.

FIG. 1 shows an exemplary configuration of connection between a scan line drive circuit 10 and a display panel 40 according to this embodiment. Note that the following description will take an example in the case where the display panel 40 (pixel array) has a dual gate structure. However, the invention is not limited thereto. For example, the driving technique according to this embodiment is also applicable to a display panel having a triple gate structure or the like. A pixel array with 15×5 pixels is shown in FIG. 1. However, the invention is not limited thereto. The driving technique according to this embodiment is also applicable to pixel arrays with p×q pixels. Here, p and q are integers that are 3 or greater.

The scan line drive circuit 10 outputs selection signals GV1 to GV10 (selection voltages) to select scan lines G1 to G10 (gate lines) in the display panel 40. That is to say, the scan line drive circuit 10 selects a scan line Gi by activating a selection signal GVi (i.e. set the selection signal GVi to a first logic level, e.g. high level), and thus enables writing to pixels connected to the scan line Gi. Here, i is an integer that is 1 or greater and 10 (=2q) or smaller.

The display panel 40 is an active matrix display panel having a dual gate structure. For example, the display panel 40 is a liquid-crystal display panel, a display panel using self-light emitting elements (EL (Electro-Luminescence) display panel), or the like.

The display panel 40 in FIG. 1 is provided with two scan lines corresponding to each display line in a horizontal scan direction, and pixels on each display line is selected in time-series by these two scan lines. Taking a first display line as an example, a first scan line G1 and a second scan line G2 are provided corresponding to the first display line. The first display line includes a first pixel group that is to be selected by the first scan line G1 (i.e. connected to the first scan line G1) and a second pixel group that is to be selected by the second scan line G2 (i.e. connected to the second scan line G2). Each data line (each one of a plurality of data lines S1 to S8) is shared by one pixel in the first pixel group and one pixel in the second pixel group. That is to say, two pixels that are adjacent to each other with a data line Sj therebetween in the horizontal scan direction are connected to the data line Sj. One of these two pixels belongs to the first pixel group, and the other one belongs to the second pixel group. The two pixels that share the data line Sj are selected in time-series by the first scan line G1 and the second scan line G2. Here, j is an integer that is 1 or greater and 8 (p/2 or (p+1)/2) or smaller.

Figure 2:
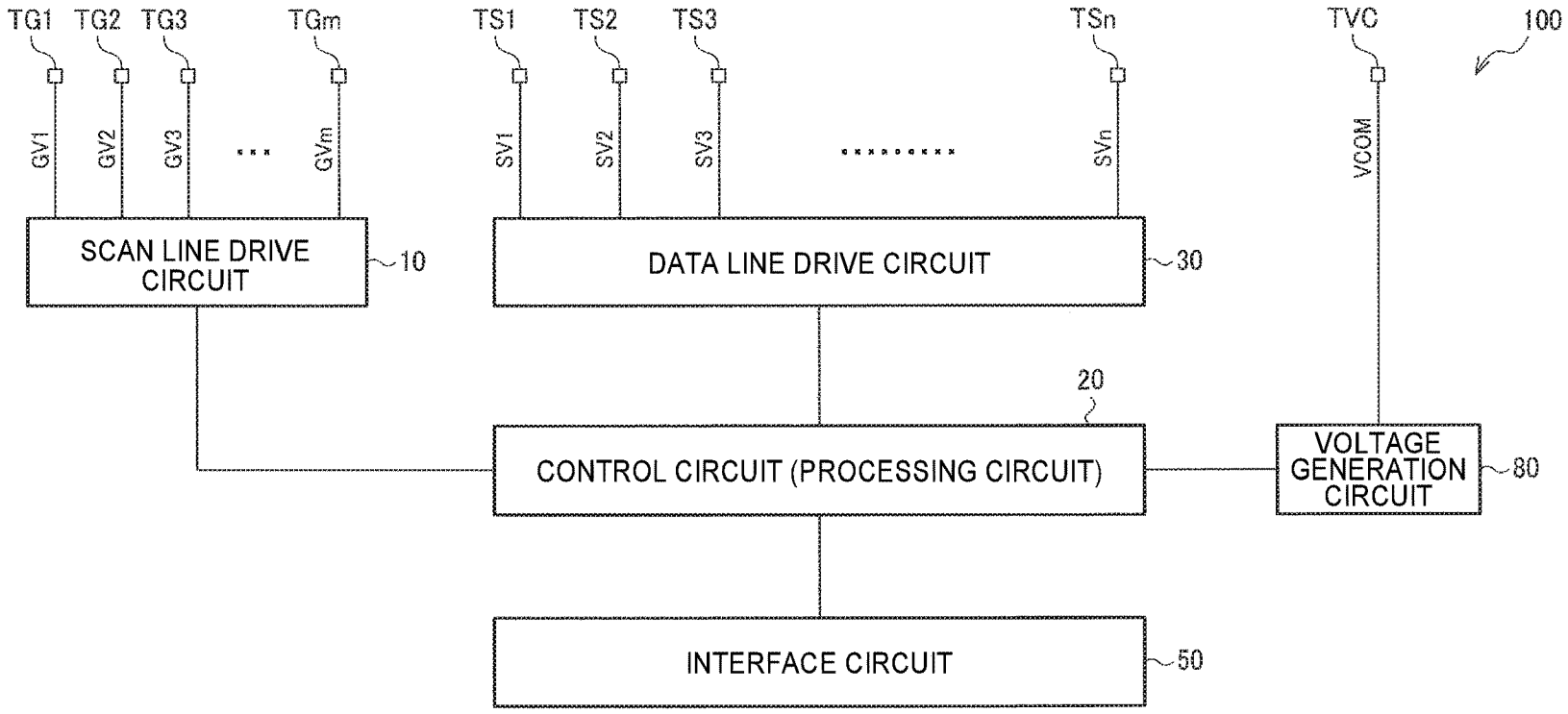
FIG. 2 shows an exemplary configuration of a display driver.

FIG. 2 shows an exemplary configuration of the display driver 100 that includes the scan line drive circuit 10 according to this embodiment. Although the following description will take an example in the case where the scan line drive circuit 10 is included in the display driver 100, the invention is not limited thereto. The scan line drive circuit 10 may be provided outside the display driver 100. For example, the scan line drive circuit 10 may be formed on a substrate in the display panel 40 (e.g. by a TFT etc.).

The display driver 100 includes a scan line drive circuit 10 (scan line drive unit), a control circuit 20 (control unit, processing circuit), a data line drive circuit 30 (data line drive unit), an interface circuit 50 (interface unit), a voltage generation circuit 80 (voltage generation unit), terminals TS1 to TSn, terminals TG1 to TGm, and a terminal TVC. Here, n and m are integers that are 3 or greater. For example, in the case of applying the display driver 100 to the display panel 40 in FIG. 1, n=8 and m=10.

The display driver 100 is a circuit device, and is implemented with an integrated circuit device (IC) or the like, for example. The terminals TS1 to TSn, terminals TG1 to TGm, and terminal TVC are pads of semiconductor chips on the integrated circuit device, or terminals of an integrated circuit device package, for example.

The interface circuit 50 communicates with external processers (e.g. display controller, MPU, CPU etc.) Communication refers to a transfer of display data (image data), a supply of a clock signal and a synchronizing signal, a transfer of a command (or a control signal), or the like, for example. The interface circuit 50 is constituted by an I/O buffer or the like, for example.

The control circuit 20 performs display data processing, timing control, control of each unit of the display driver 100, and the like based on the display data, clock signal, synchronizing signal, command, and the like that are input via the interface circuit 50. In the display data processing, for example, image processing such as tone correction is performed. In the timing control, the timing of driving scan lines and the timing of driving data lines in a display panel are controlled based on the synchronizing signal and display data. The polarity of a data voltage that is to be written to each pixel is controlled. The control circuit 20 is constituted by a logic circuit such as a gate array, for example.

The data line drive circuit 30 includes a tone voltage generation circuit and a plurality of drive circuits. The drive circuits each include a D/A converter circuit and an amplifier circuit. The tone voltage generation circuit outputs a plurality of voltages, and each of these voltages corresponds to one of a plurality of tone values. The D/A converter circuit selects a voltage corresponding to the display data from among the plurality of voltages from the tone voltage generation circuit. The amplifier circuit amplifies the voltage from the D/A converter circuit and outputs the data voltage. Data voltages SV1 to SVn are thus output to the terminals TS1 to TSn by the plurality of drive circuits, and the data lines in the display panel 40 are driven. For example, each drive circuit is provided corresponding to two data lines, and drives these two data lines with opposite polarities. Otherwise, each drive circuit is provided corresponding to one data line. The tone voltage generation circuit is constituted by a ladder resistor or the like, for example. The D/A converter circuit is constituted by a switching circuit or the like, for example. The amplifier circuit is constituted by an operational amplifier, a capacitor, a resistor, and the like, for example.

The scan line drive circuit 10 outputs the selection signals GV1 to GVm to the terminals TG1 to TGm, and drives (selects) a scan line in the display panel. For example, the scan line drive circuit 10 is constituted by a circuit that generates a signal to designate a scan line to be selected, a buffer circuit that buffers this signal and outputs it as any one of the selection signals GV1 to GV10, and the like.

The voltage generation circuit 80 generates a common voltage VCOM, which is supplied to a common electrode of the display panel 40, and outputs this common voltage VCOM to the terminal TVC. The voltage generation circuit 80 also generates a voltage, which is supplied to each unit of the display driver 100. For example, the voltage generation circuit 80 generates a power supply voltage for the buffer circuit in the scan line drive circuit 10, a power supply voltage for the amplifier circuits in the data line drive circuit 30, and the like. For example, the voltage generation circuit 80 is constituted by a voltage booster circuit, a regulator, a resistance voltage divider circuit, or the like.

2. Operation

Figure 3:
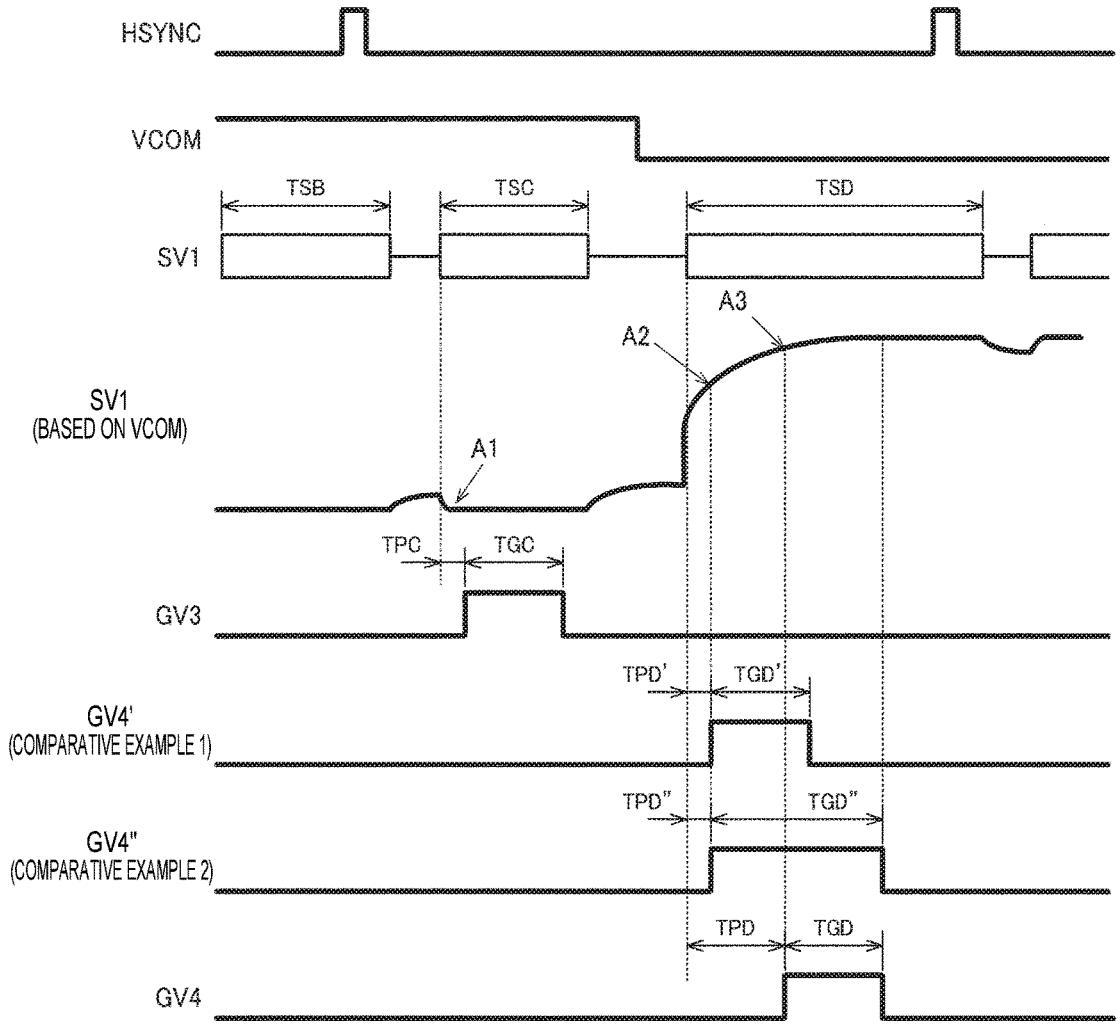
FIG. 3 is a first timing chart illustrating operations of the display driver.

FIG. 3 is the first timing chart illustrating operations of the display driver 100. Note that the following description will take an example in the case of changing the polarity of the data voltage by changing the common voltage VCOM. However, the invention is not limited thereto. The polarity of the data voltage may be changed while the common voltage VCOM is set constant. That is to say, the polarity of the data voltage indicates a relative relationship between the data voltage output to a data line and the common voltage. For example, the data voltage has positive polarity when the data voltage is higher than the common voltage VCOM, whereas the data voltage has negative polarity when the data voltage is lower than the common voltage VCOM.

A signal HSYNC denotes a horizontal scan signal, and a period between two rising edges (or falling edges) of the signal HSYNC corresponds to a horizontal scanning period. Two scan lines are sequentially selected during one horizontal scanning period.

Taking the data voltage SV1 as an example, data voltages that are to be written to pixels PB, PC, and PD shown in FIG. 1 are output to the data line 51 during periods TSB, TSC, and TSD, respectively. Here, signs "+" and "−" assigned to the pixels in FIG. 1 indicate the polarities in a certain frame. "+" indicates positive polarity, and "−" indicates negative polarity. This polarity is inverted at every frame. In FIG. 1, the polarities at the pixels PB, PC, and PD are negative, negative, and positive, respectively. Accordingly, the common voltage VCOM in FIG. 2 changes between the periods TSC and TSD. The polarity of the data voltage SV1, which is based on the common voltage VCOM, is negative, negative, and positive respectively in the periods TSB, TSC, and TSD.

The selection signal GV4 on the scan line G4 is maintained in an active state (i.e. is active) during a selection period TGD (first selection period) within the period TSD. The selection signal GV4 is maintained in an inactive state (i.e. is inactive) in periods other than the selection period TGD within the period TSD. Since the polarity of the data voltage SV1 changes from negative to positive between the periods TSC and TSD, the period TSD (first period) is a period in which the data voltage SV1 after being subjected to polarity inversion is supplied to the data line 51. The period from the start of this period TSD until the selection signal GV4 is activated will be denoted as TPD.

The selection signal GV3 on the scan line G3 is maintained in an active state during a selection period TGC (second selection period) within the period TSC. The selection signal GV3 is maintained in an inactive state in periods other than the selection period TGC within the period TSC. Since the polarity of the data voltage SV1 is negative during both periods TSB and TSC, the period TSC (second period) is a period in which the data voltage SV1 after not being subjected to polarity inversion is supplied to the data line 51. When the period from the start of this period TSC until the selection signal GV3 is activated is denoted as TPC, the period TPD is longer than the period TPC.

According to this embodiment, degradation of display quality can be prevented due to the scan line drive circuit 10 outputting the above-described selection signals GV3 and GV4. This point will now be described using comparative examples.

The selection signals GV4' and GV4" shown in FIG. 3 are first and second comparative examples of the selection signal GV4. The lengths of periods TPD' and TPD" from the start of the period TSD until the selection signals GV4' and GV4" are activated, respectively, are the same as the length of the period TPC.

In the first comparative example, a selection period TGD' in which the selection signal GV4' is maintained in an active state is the same as the selection period TGC in which the selection signal GV3 is maintained in an active state. As denoted by A1 in FIG. 3, regarding the data voltage SV1 (which is the voltage on a data line; a potential difference between the potential on the data line and the potential of the common voltage) in the case where the polarity has not been inverted, a voltage change from when the data line was previously driven (i.e. from the period TSB) is small. For this reason, the time taken from the start of the period TSC (i.e. from when the data voltage began to be written to the data line) until the settling (i.e. until the potential on the data line reaches a target value) is short. For this reason, a desired voltage can be written to the pixel until the selection period TGC in which the selection signal GV3 is maintained in an active state ends. On the other hand, as denoted by A2, regarding the data voltage SV1 (the voltage on the data line) in the case where the polarity has been inverted, a voltage change from when the data line was previously driven (i.e. from the period TSC) is large. For this reason, the time taken from the start of the period TSD until the settling is long. As a result, a desired voltage may not be able to be written to the pixel until the selection period TGD' in which the selection signal GV4' is maintained in an active state ends.

To solve this problem, in the second comparative example, a selection period TGD" in which the selection signal GV4" is maintained in an active state is longer than the selection period TGC in which the selection signal GV3 is maintained in an active state. By setting a long selection period TGC, even in the case where the data voltage SV1 whose polarity has been inverted takes long time to settle, a desired voltage can be written to the pixel until the selection period TGD" in which the selection signal GV4" is maintained in an active state ends. However, conditions applied during the selection period TGD" are different in the following two points from those during the selection period TGC in which the selection signal GV3 is maintained in an active state. The first point is that, at the timing of the start of the selection period TGD" in which the selection signal GV4" is maintained in an active state, the data voltage SV1 has not settled to a desired voltage (i.e. has not reached a charged state that is similar to the charged state of the data voltage SV1 at the timing of the start of the selection period TGC). The second point is that the selection period TGD" in which the selection signal GV4" is maintained in an active state is longer than the selection period TGC. These differences in the conditions may cause an error in a writing voltage for a pixel, or the like, for example. For this reason, it is desirable that writing to a pixel is performed under the same conditions as much as possible regardless of whether or not the polarity has been inverted.

In this regard, in this embodiment, the period TPD from the start of the period TSD after polarity inversion (i.e. from when the data line begins to be charged) until the selection signal GV4 is activated (i.e. until the pixel begins to be charged) is longer than the period TPC from the start of this period TSC after the polarity has not been inverted until the selection signal GV3 is activated. Thus, as denoted by A3, a state can be achieved where the data voltage SV1 has been settled to a desired voltage at the timing of the start of the selection period TGD in which the selection signal GV4 is maintained in an active state. Then, a desired voltage can be written to the pixel by the end of the selection period TGD. Note that the data voltage SV1 does not need to have settled to a desired voltage at the timing of the start of the selection period TGD. A state need only be achieved where the data line has been charged to the same degree at the timings of the start of the selection periods TGC and TGD.

In this embodiment, the length of the first selection period TGD in which the selection signal GV4 is maintained in an active state within the first period TSD is the same as the length of the second selection period TGC in which the selection signal GV3 is maintained in an active state within the second period TSC.

Due to the same length of the selection periods TGC and TGD, the time taken from the start of the period TSD until the selection period TGD ends is longer than the time taken from the start of the period TSC until the selection period TGC ends. With this configuration, the time taken until the selection period TGD ends can be secured in the case where the polarity has been inverted and the settling of the data voltage SV1 takes time, and the pixel can be sufficiently charged to a desired voltage. In addition, due to the same length of the periods TSC and TSD, writing to the pixel can be performed under the same conditions as much as possible regardless of whether or not the polarity has been inverted.

In this embodiment, the first period TSD is a period after the polarity of the data voltage SV1 has been inverted by switching a first common voltage, which is higher than the data voltage SV1, to a second common voltage, which is lower than the data voltage SV1.

That is to say, in this embodiment, the polarity of data voltage is changed by changing the common voltage VCOM. As described above, a difference occurs in the settling time of the data voltage between the case where the polarity of the data voltage has not been switched and the case where the polarity has been switched. In this regard, in this embodiment, the difference in the settling time is handled by differentiating the time from the start of output of the data voltage until the selection signal is activated.

Figure 4:
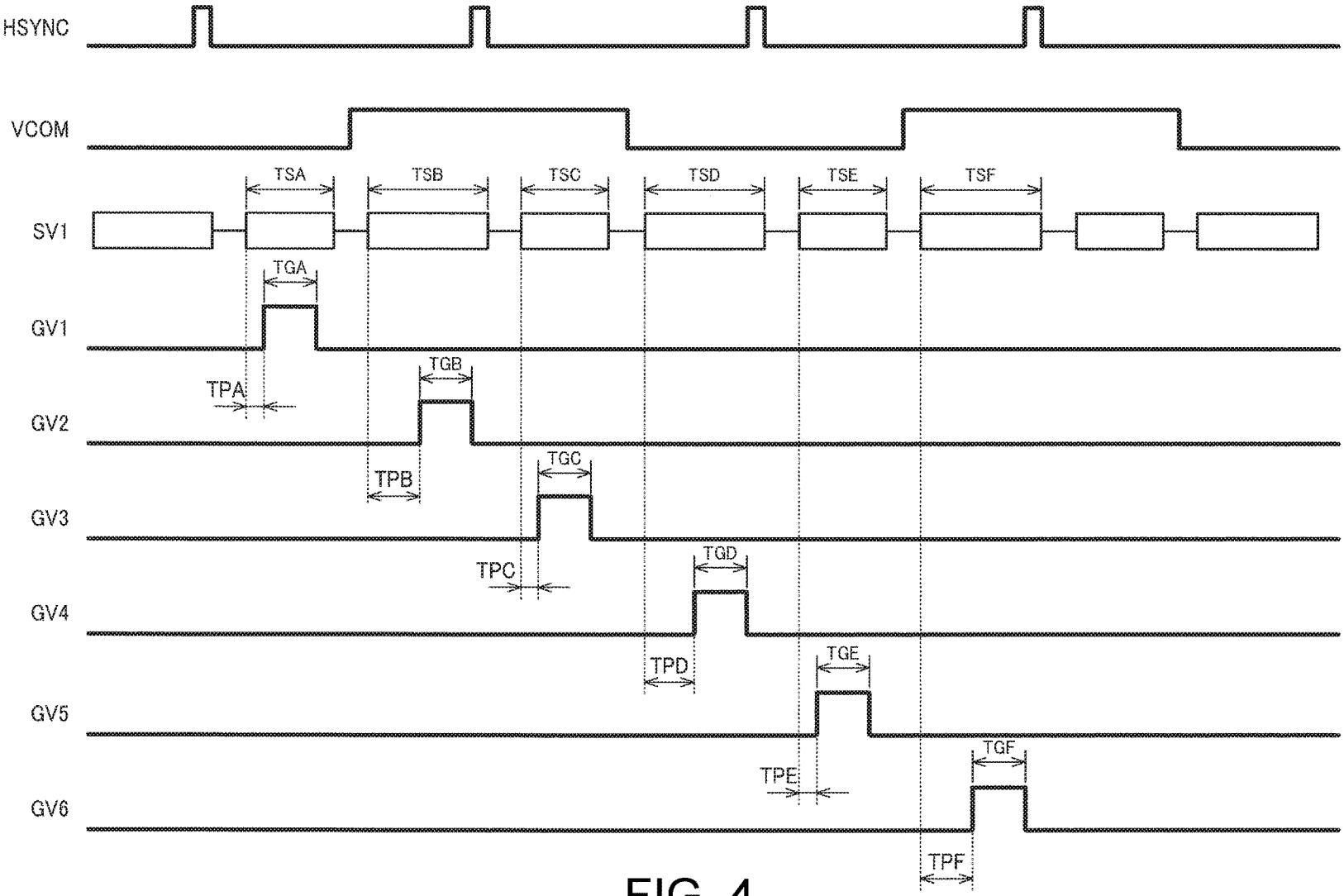
FIG. 4 is a second timing chart illustrating operations of the display driver.

FIG. 4 is the second timing chart illustrating operations of the display driver 100. FIG. 4 shows a timing chart at the time of driving pixels PA to PF in FIG. 1.

As shown in FIG. 4, the data voltage SV1 that drives the pixels PA, PB, PC, PD, PE, and PF are output during periods TSA, TSB, TSC, TSD, TSE, and TSF, and the polarity of the data voltage SV1 in the respective periods is positive, negative, negative, positive, positive, and negative. That is to say, the periods TSB, TSD, and TSF are periods after the polarity has been inverted, and the periods TSA, TSC, and TSE are periods after the polarity has not been inverted. Here, the polarity having not been inverted means that the polarity was not inverted in a period from when the pixel (data line) was previously driven until the pixel (data line) is driven at this time.

FIG. 3 illustrates that TPD is longer than TPC, taking an example of the period TSC after the polarity has been maintained at negative and has not been inverted, and the period TSD after the polarity has been inverted from negative to positive (i.e. the period after the common voltage has been switched from the first common voltage to the second common voltage). However, the invention is not limited thereto. That is to say, TPF in a period TSF after the polarity has been inverted from positive to negative (i.e. the period after the common voltage has been switched from the second common voltage to the first common voltage) is also longer than TPE in a period TSE after the polarity has been maintained at positive and has not been inverted. Also, TGE is equal to TGF. Periods TPE and TPF are periods from the start of the periods TSE and TSF until selection signals GV5 and GV6 are activated, respectively. Selection periods TGE and TGF are periods in which the selection signals GV5 and GV6 are active, respectively. Note that, for example, even though TPC is equal to TPE and TPD is equal to TPF, the invention is not limited thereto. The lengths of the periods TPC and TPE may differ from each other, and the lengths of the periods TPD and TPF may differ from each other.

The above-described periods are controlled in the following manner, for example. That is to say, the control circuit 20 in FIG. 2 has a timing controller, and this timing controller controls the operation timing based on, for example, a count value of a counter that counts the clock signal. The start timing (count value), length, and end timing (count value) of the respective periods are preset or set through register settings. The timing controller generates respective control signals based on the set values and controls the periods. The data line drive circuit 30 and the scan line drive circuit 10 output a data voltage and a scan line selection signal based on the control signals from the timing controller. Note that the invention is not limited thereto, and may employ a configuration in which the scan line drive circuit 10 includes a circuit to control the respective periods for the selection signals.

Note that this embodiment may also employ the following configuration. That is to say, the display driver 100 drives the display panel 40. The display panel 40 includes a plurality of scan lines G1 to G10, data lines S1 to S8, which intersect the plurality of scan lines G1 to G10, and a plurality of pixels, which are formed at positions where the plurality of scan lines G1 to G10 intersect the data lines S1 to S8. The display driver 100 (e.g. the data line drive circuit in the display driver 100) performs first driving and second driving. During the first driving, a first data voltage having one of a first polarity and a second polarity, which is different from the first polarity, is supplied to the data line. Thereafter, a second data voltage having the other one of the first polarity and the second polarity is supplied to the data line. During the second driving, a third data voltage having one of a third polarity and a fourth polarity, which is different from the third polarity, is supplied to the data line. Thereafter, a fourth data voltage having the other one of the third polarity and the fourth polarity is supplied to the data line. After the supply of the second data voltage to the data line has started during the first driving, the display driver 100 (e.g. the scan line drive circuit 10 in the display driver 100) selects a scan line after a first non-selection period (TPD). After the supply of the fourth data voltage to the data line has started during the second driving, the display driver 100 selects a scan line after a second non-selection period (TPC). The first non-selection period (TPD) is longer than the second non-selection period (TPC).

Note that the above-described operations of the scan line drive circuit 10 can be performed as a driving method to output a selection signal to select a scan line in the display panel 40 (i.e. an operation method of the scan line drive circuit 10 or the display driver 100). That is to say, the selection signals GV3 and GV4 are output so that the period TPD from the start of the first period TSD in which the data voltage SV1 after being subjected to polarity inversion is supplied to the data line S1 in the display panel 40 until the selection signal GV4 is activated is longer than the period TPC from the start of the second period TSC in which the data voltage SV1 after not being subjected to polarity inversion is supplied to the data line S1 until the selection signal GV3 is activated.

The following driving method may also be employed. That is to say, the display panel 40 includes a plurality of scan lines G1 to G10, data lines S1 to S8, which intersect the plurality of scan lines G1 to G10, and a plurality of pixels, which are formed at positions where the plurality of scan lines G1 to G10 intersect the data lines S1 to S8. In a method to drive this display panel 40, first driving and second driving are performed. In this method, the period (TPD) from when the supply of the second data voltage to the data line has started until a scan line is selected during the first driving is longer than the period (TPC) from when the supply of the fourth data voltage to the data line has started until a scan line is selected during the second driving. During the first driving, a first data voltage having one of a first polarity and a second polarity, which is different from the first polarity, is supplied to the data line. Thereafter, a second data voltage having the other one of the first polarity and the second polarity is supplied to the data line. During the second driving, the third data voltage having one of a third polarity and a fourth polarity, which is different from the third polarity, is supplied to the data lines. Thereafter, a fourth data voltage having the other one of the third polarity and the fourth polarity is supplied to the data line.

3. Driving Technique for Double-on Driving

Figure 5:
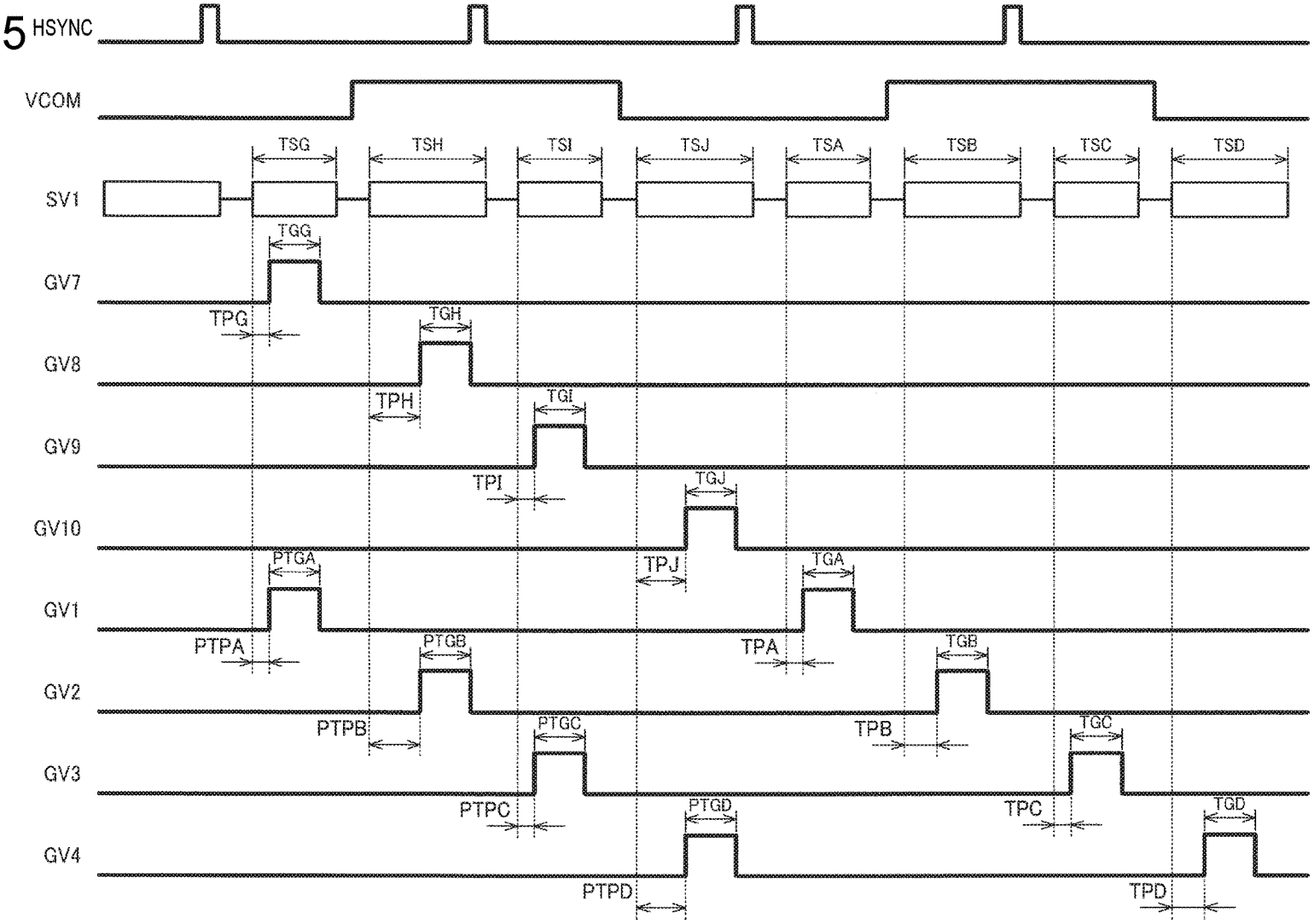
FIG. 5 is a timing chart illustrating operations of the display driver in the case of performing double-on driving.

FIG. 5 is a timing chart illustrating operations of the display driver 100 in the case of performing double-on driving. FIG. 5 shows a timing chart at the time of driving pixels PG to PJ and PA to PD in FIG. 1.

As shown in FIG. 5, the scan line drive circuit 10 maintains the selection signal GV1 to select the first scan line G1 in an active state during a selection period PTGA within the period TSG (third period) and the selection period TGA within the period TSA (fourth period). The periods TSG and TSA are periods in which the data voltage SV1 to drive the pixels PG and PA, respectively, is supplied to the data line S1. In the example in FIG. 5, the polarity of the data voltage SV1 is positive during the periods TSG and TSA. That is to say, the period TSG is a period in which the data voltage SV1 having the same polarity as that of the data voltage SV1 to drive the pixel PA (first pixel group) is supplied to the data line S1. Note that although the polarity at the pixel PG is negative in FIG. 1, it is positive in FIG. 5, which illustrates driving of the pixel PG in the previous frame.

Also, the scan line drive circuit 10 maintains the selection signal GV2 to select the second scan line G2 in an active state during a selection period PTGB within a period TSH (fifth period) and the selection period TGB within the period TSB (sixth period). The periods TSH and TSB are periods in which the data voltage SV1 to drive the pixels PH and PB, respectively, is supplied to the data line S1. In the example in FIG. 5, the polarity of the data voltage SV1 is negative during the periods TSH and TSB. That is to say, the period TSH is a period in which the data voltage SV1 having the same polarity as that of the data voltage SV1 to drive the pixel PB (second pixel group) is supplied to the data line S1. Note that although the polarity at the pixel PH is positive in FIG. 1, it is negative in FIG. 5, which illustrates driving of the pixel PH in the previous frame.

The technique to thus activate a selection signal at a timing at which writing to pixels with the same polarity is performed and perform pre-driving will be called double-on driving. With this technique, pixels are charged in advance with a data voltage having the same polarity. As a result, the settling time can be shortened when the data voltage for this pixel is written thereto, and the display quality can be increased.

The driving technique according to this embodiment described using FIG. 3 and the like is also applicable to the case of performing such double-on driving.

That is to say, the sixth period TSB is a period after the polarity of the data voltage SV1 has been inverted. In this case, the period TPB from the start of the period TSB until the selection signal GV2 is activated is longer than the period TPA. The period TPA is a period from the start of the period TSA in which the data voltage SV1 after not being subjected to polarity inversion is supplied to the data line S1 until the selection signal GV1 is activated.

By thus applying the driving technique according to this embodiment when writing respective data voltages to the pixels PA and PB during double-on driving, a desired voltage can be written to the pixels by the end of the selection period (i.e. the period in which the selection signal is active), regardless of whether or not the polarity has been inverted. Thus, the display quality during double-on driving can be increased.

Note that FIG. 5 shows the case where the sixth period TSB is a period after the polarity has been inverted. However, the invention is not limited thereto. The fourth period TSA may be a period after the polarity has been inverted. In this case, the period TPA from the start of the period TSA until the selection signal GV1 is activated is longer than the period from the start of the period in which the data voltage SV1 after not being subjected to polarity inversion is supplied to the data line S1 until the selection signal is activated.

In this embodiment, the fifth period TSH is a period after the polarity of the data voltage SV1 has been inverted. In this case, a period PTPB from the start of the period TSH until the selection signal GV2 is activated is longer than a period PTPA. The period PTPA is a period from the start of the period TSG in which the data voltage SV1 after not being subjected to polarity inversion is supplied to the data line S1 until the selection signal GV1 is activated.

By thus applying the driving technique according to this embodiment when pre-driving the pixels PA and PB during double-on driving, the pre-driving voltage can be written to the pixels by the end of the selection period (i.e. the period in which the selection signal is active), regardless of whether or not the polarity has been inverted. Thus, the display quality can be further increased. That is to say, a state can be achieved where the data voltage SV1 has been charged to the pre-driving voltage to the same degree (i.e. has settled to the same degree) at the timing of the start of the selection period PTGB in which the selection signal GV2 is maintained in an active state, and at the timing of the start of the selection period PTGA in which the selection signal GV1 is maintained in an active state.

Note that FIG. 5 shows the case where the fifth period TSH is a period after the polarity has been inverted. However, the invention is not limited thereto. The third period TSG may be a period after the polarity is inverted. In this case, the period PTPA from the start of the period TSG until the selection signal GV1 is activated is longer than the period from the start of the period in which the data voltage SV1 after not being subjected to polarity inversion is supplied to the data line S1 until the selection signal is activated.

4. Technique to Drive Display Panel Having Triple Gate Structure

Figure 6:
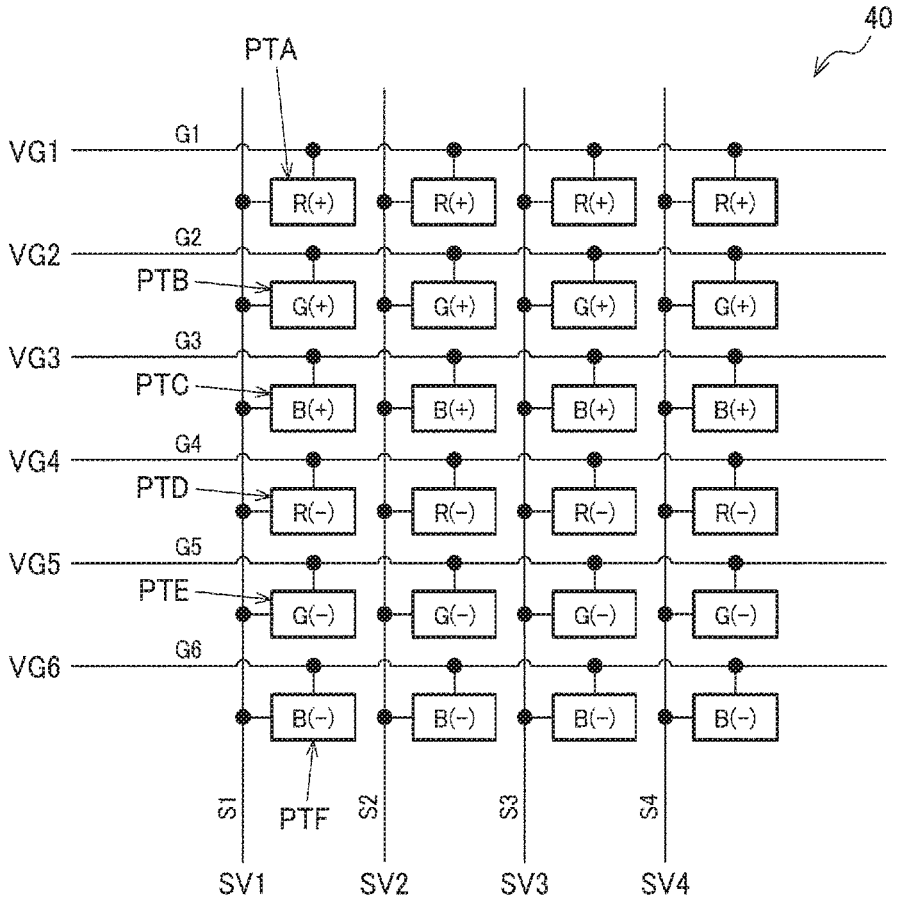
FIG. 6 shows an exemplary configuration of a display panel having a triple gate structure.

FIG. 6 shows an exemplary configuration of the display panel 40 having a triple gate structure. Note that FIG. 6 shows a pixel array with 4×6 pixels, but the invention is not limited thereto. The driving technique according to this embodiment is also applicable to pixel arrays having s×t pixels. Here, s and t are integers that are 2 or greater.

The display panel 40 in FIG. 6 has pixels on a first display line that is selected by a first scan line G1, pixels on a second display line that is selected by a second scan line G2, and pixels on a third display line that is selected by a third scan line G3. The pixels on the first display line, the pixels on the second display line, and the pixels on the third pixel line have different colors. For example, the pixels on the first, second, and third display lines are red (R) pixels, green (G) pixels, and blue (B) pixels, respectively. Similarly, the display panel 40 has pixels on fourth, fifth, and sixth display lines that are selected respectively by fourth, fifth, and sixth scan lines G4, G5, and G6. For example, the pixels on the fourth, fifth, and sixth display lines are red (R) pixels, green (G) pixels, and blue (B) pixels, respectively.

Thus, in the display panel having a triple gate structure, R, G, and B pixels are arranged in this order in the vertical direction (vertical scan direction) of the pixel array. The driving technique according to this embodiment described using FIG. 3 and the like is also applicable to the case of driving the display panel 40 having such a triple gate structure.

When driving a display panel having a triple gate structure, usually, line inversion driving is performed, i.e. the polarity of the data voltage is inverted at every display line. However, driving can also be performed so as to invert the polarity of the data voltage at every several display lines. It is assumed in this embodiment that such driving is performed. The following description will take an example in the case of inverting the polarity of the data voltage at every three display lines.

Figure 7:
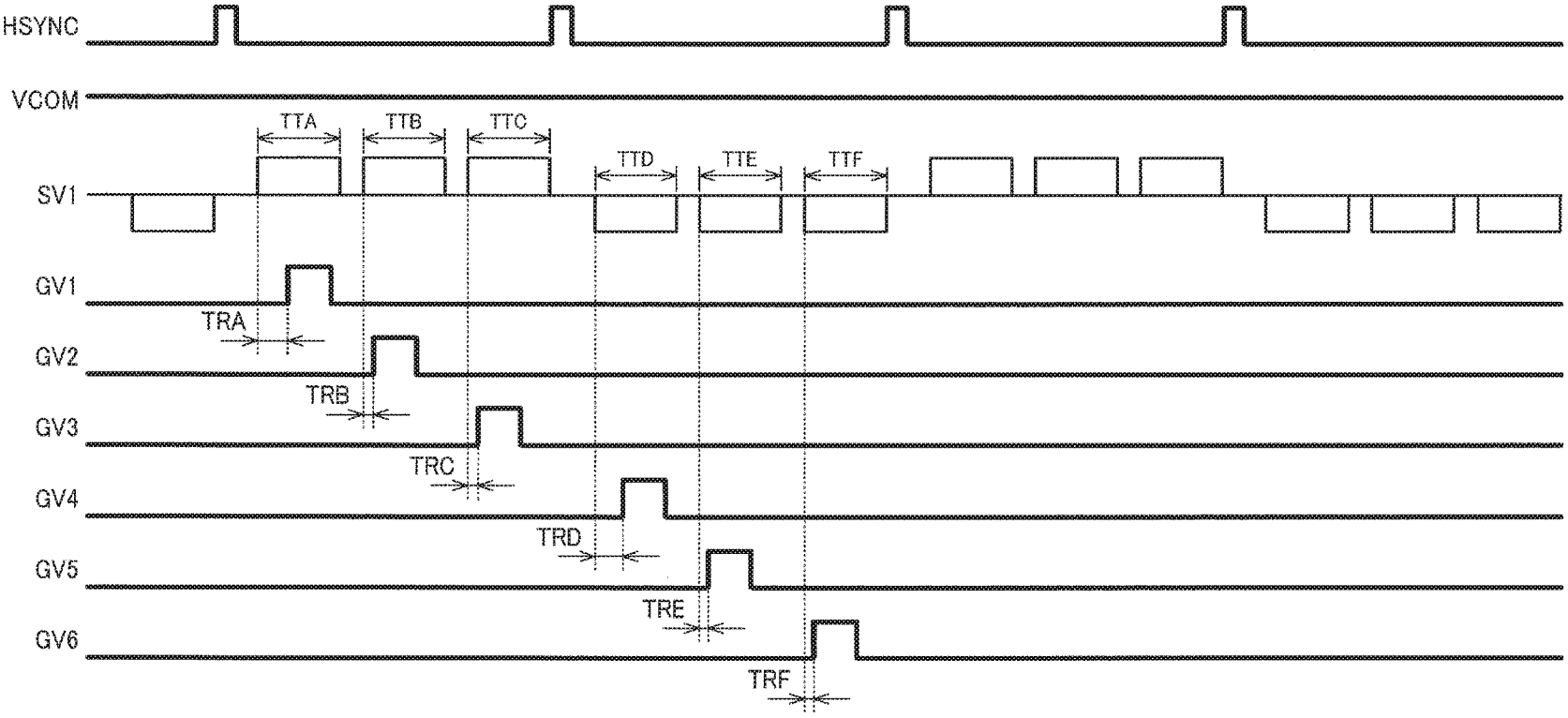
FIG. 7 is a timing chart illustrating operations of the display driver in the case of driving the display panel having a triple gate structure.

FIG. 7 is a timing chart illustrating operations of the display driver 100 in the case of driving the display panel having a triple gate structure.

As shown in FIG. 7, when driving a display panel having a triple gate structure, three scan lines are selected and pixels on three display lines are driven during one horizontal scanning period. The polarity of the data voltage is inverted every horizontal scanning period. For example, in a horizontal scanning period in which the scan lines G1, G2, and G3 (first to third display lines) are selected, the polarity of the data voltage SV1 is positive. In a horizontal scanning period in which the scan lines G4, G5, and G6 (fourth to sixth display lines) are selected, the polarity of the data voltage SV1 is negative. Note that, here, the common voltage VCOM is constant. That is to say, when the polarity of the data voltage is positive, a data voltage that is higher than the common voltage VCOM is output. When the polarity of the data voltage is negative, a data voltage that is lower than the common voltage VCOM is output.

Taking the data voltage SV1 as an example, data voltages to drive pixels PTA, PTB, PTC, PTD, PTE, and PTF in FIG. 6 are output in periods TTA, TTB, TTC, TTD, TTE, and TTF, respectively. Periods TRA and TRD are periods from the start of the periods TTA and TTD, in which the data voltage SV1 after being subjected to polarity inversion is supplied to the data line S1, until the selection signals GV1 and GV4 are activated, respectively. Periods TRB, TRC, TRE, and TRF are periods from the start of the periods TTB, TTC, TTE, and TTF, in which the data voltage SV1 after not being subjected to polarity inversion is supplied to the data line S1, until the selection signals GV2, GV3, GV5, and GV6 are activated, respectively. At this time, the periods TRA and TRD are longer than the periods TRB, TRC, TRE, and TRF.

Thus, in the case of driving the display panel 40 having a triple gate structure as well, it is possible to handle a difference in the settling time between the periods after the polarity has been inverted and the periods after the polarity has not been inverted, by differentiating the time from the start of output of the data voltage until the selection signal is activated.

Note that, in the case of inverting the polarity at every frame, the polarity of the data voltage SV1 in the period TTF in the previous frame in FIG. 7 is positive. In this case, since the polarity of the data voltage SV1 is the same in the period TTF in the previous frame and the period TTA in FIG. 7, the length of the period TRA is the same as the length of the period TRB. Even in the case of inverting the polarity at every frame, if the number of pixels in the vertical direction is an odd number (an odd multiple of 3), the polarity of the data voltage SV1 in the last horizontal scan line in the previous frame is different from the polarity of the data voltage SV1 in the period TTA in FIG. 7. Accordingly, the length of the period TRA is longer than the length of the period TRB.

5. Modifications of Technique to Drive Display Panel Having Dual Gate Structure

FIGS. 1 to 5 has illustrated an example in the case of performing dot inversion driving, i.e. alternately inverting the polarity so as to be positive, negative, positive, and then negative, for example, at pixels arranged in the horizontal scan direction in the display panel having a dual gate structure. However, the invention is not limited thereto. For example, driving may be performed so as to invert the polarity at pixels arranged in the horizontal scan direction so as to be positive, positive, negative, and then negative at every two dots for example (this driving method will be called two-dot inversion driving).

Figure 8:
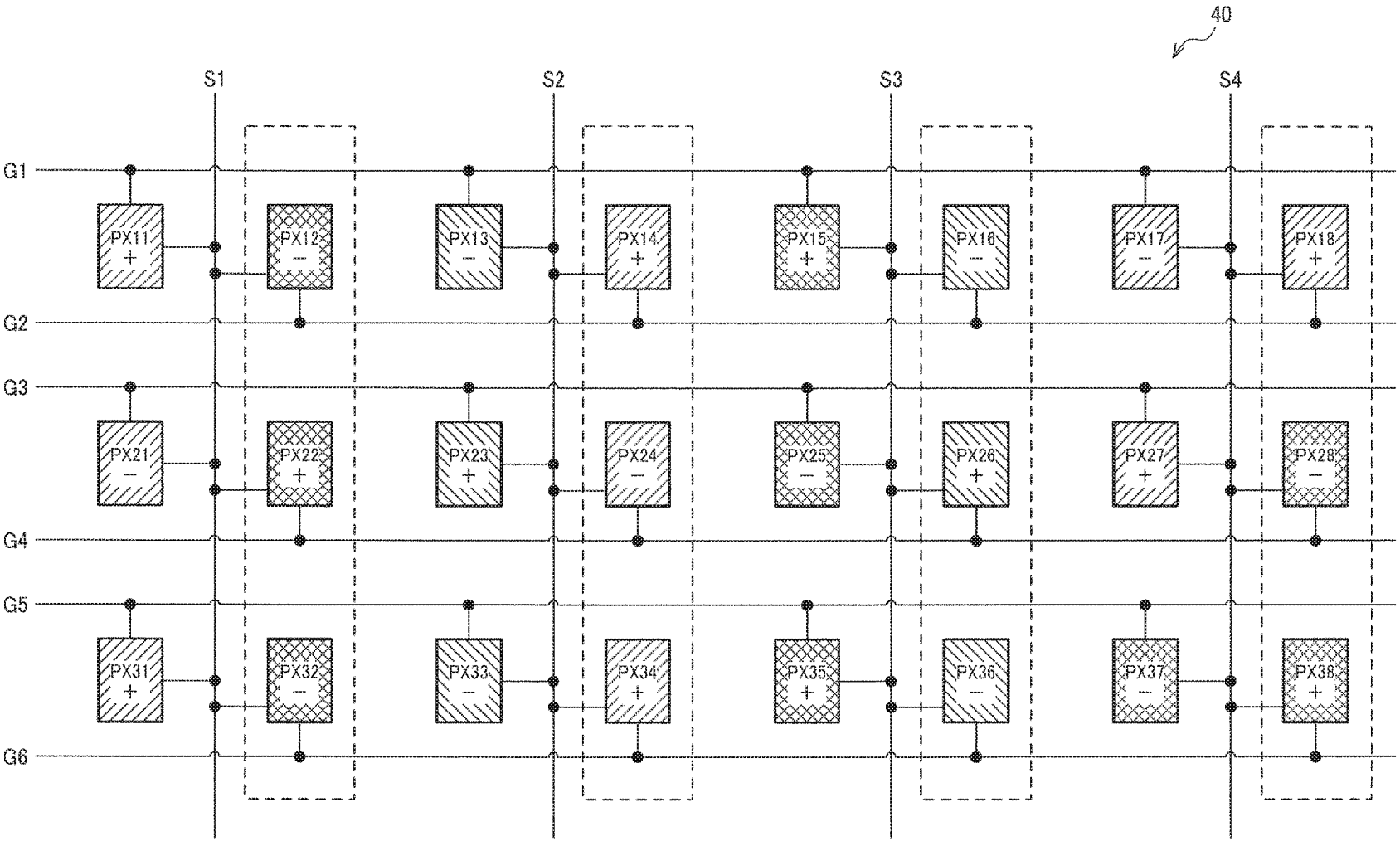
FIG. 8 shows a first modification in the case of performing two-dot inversion driving.

FIG. 8 shows a first modification in the case of performing two-dot inversion driving. Here, for example, a pixel on a first row and a second column in the pixel array will be denoted by a sign PX12. In this modification, pixels PX11, PX12, PX13, and PX14 on the first display line are driven with positive, negative, negative, and positive polarity, respectively. Pixels PX21, PX22, PX23, and PX24 on the second display line are driven with negative, positive, positive, and negative polarity, respectively. This driving is repeated alternately in the subsequent display lines. In this case, pixels surrounded by dotted lines in FIG. 8 (PX 12, PX22, PX14, PX24 etc.) are pixels that are driven after the polarity has been inverted.

Figure 9:
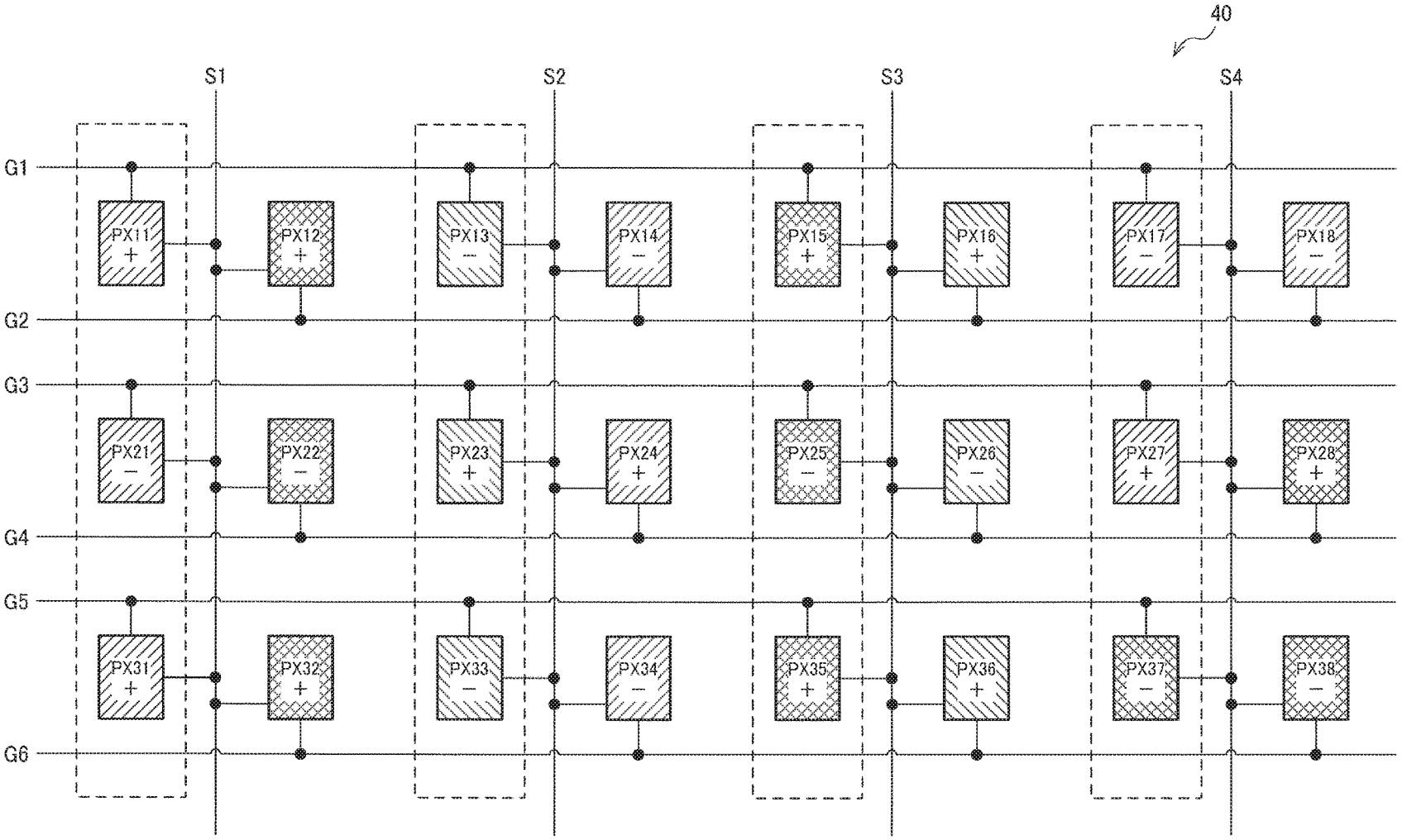
FIG. 9 shows a second modification in the case of performing two-dot inversion driving.

FIG. 9 shows a second modification in the case of performing two-dot inversion driving. In this modification, pixels PX11, PX12, PX13, and PX14 on the first display line are driven with positive, positive, negative, and negative polarity, respectively. Pixels PX21, PX22, PX23, and PX24 on the second display line are driven with negative, negative, positive, and positive polarity, respectively. This driving is repeated alternately in the subsequent display lines. In this case, pixels surrounded by dotted lines in FIG. 9 (PX 11, PX21, PX13, PX23 etc.) are pixels that are driven after the polarity has been inverted.

Figure 10:
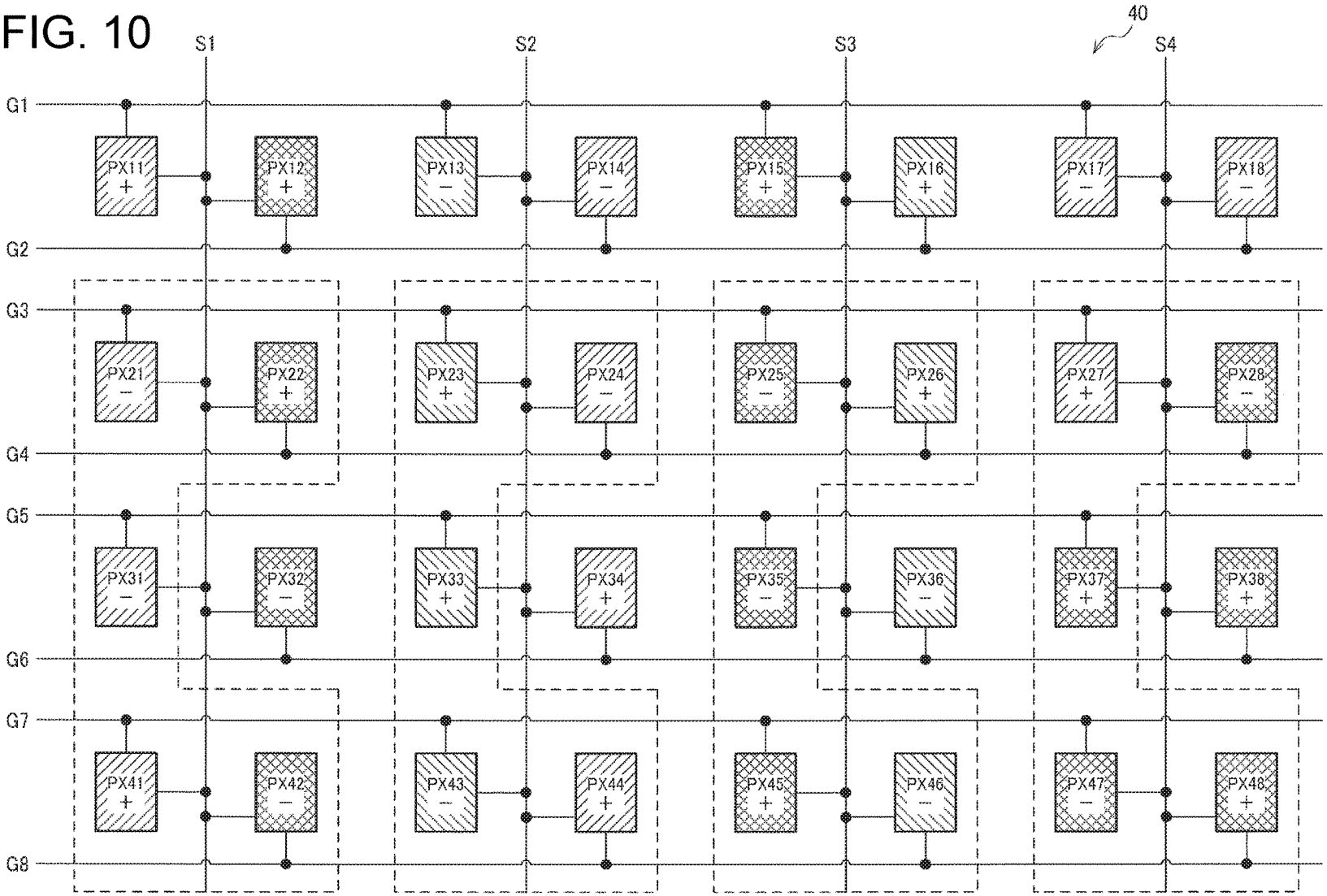
FIG. 10 shows a third modification in the case of performing two-dot inversion driving.

FIG. 10 shows a third modification in the case of performing two-dot inversion driving. In this modification, pixels PX11, PX12, PX13, and PX14 on the first display line are driven with positive, positive, negative, and negative polarity, respectively. Pixels PX21, PX22, PX23, and PX24 on the second display line are driven with negative, positive, positive, and negative polarity, respectively. In the subsequent display lines, the above-described driving is performed while shifting, in the horizontal scan direction, the polarity of each pixel one-by-one. In this case, pixels surrounded by dotted lines in FIG. 10 (PX 21, PX22, PX23, PX24 etc.) are pixels that are driven after the polarity has been inverted.

Figure 11:
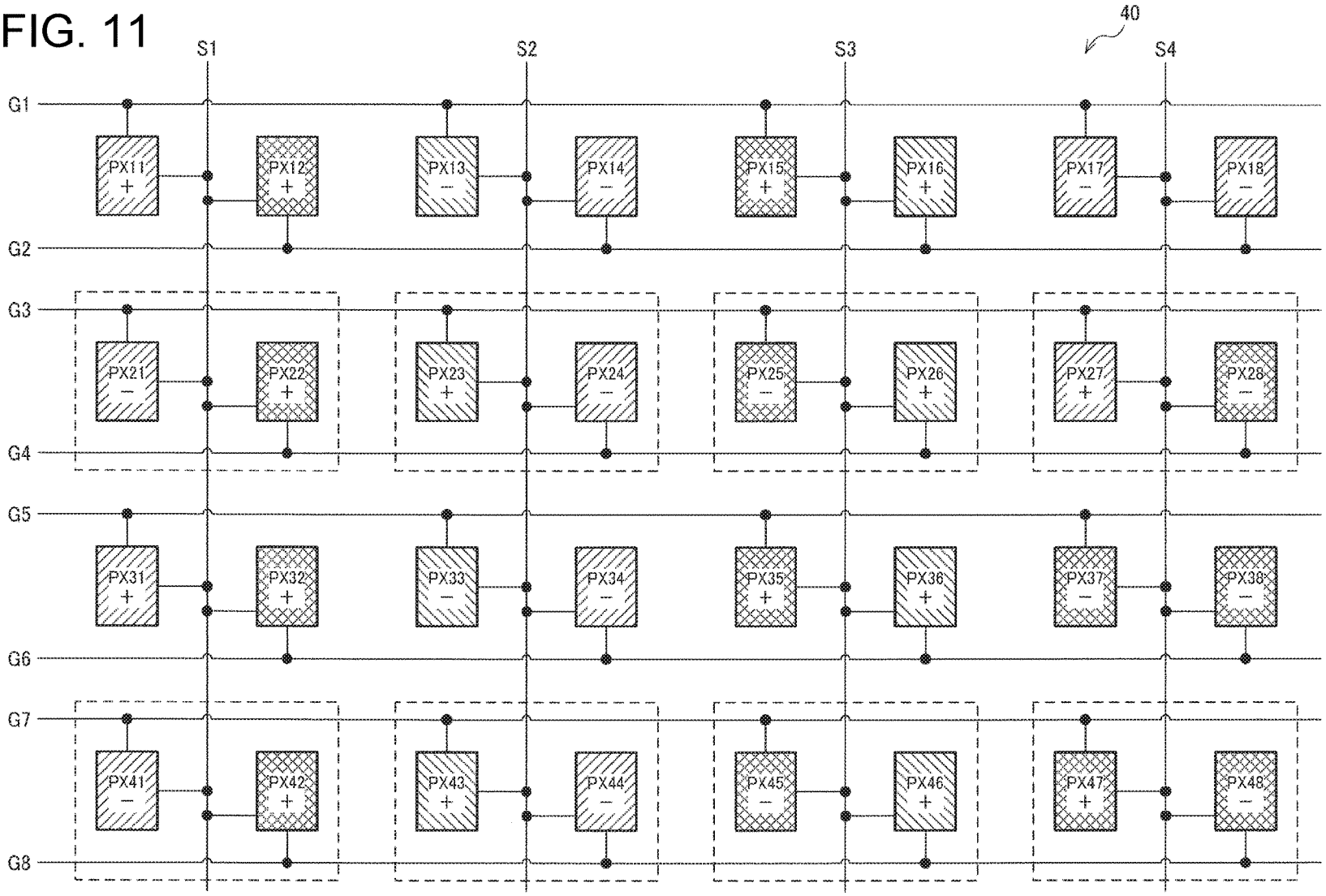
FIG. 11 shows a fourth modification in the case of performing two-dot inversion driving.

FIG. 11 shows a fourth modification in the case of performing two-dot inversion driving. In this modification, pixels PX11, PX12, PX13, and PX14 on the first display line are driven with positive, positive, negative, and negative polarity, respectively. Pixels PX21, PX22, PX23, and PX24 on the second display line are driven with negative, positive, positive, and negative polarity, respectively. The above-described driving is repeated alternately in the subsequent display lines. In this case, pixels surrounded by dotted lines in FIG. 11 (PX 21, PX22, PX23, PX24 etc.) are pixels that are driven after the polarity has been inverted.

If the driving technique according to this embodiment illustrated in FIG. 3 and the like is applied to the above two-dot inversion driving, the periods from the start of the periods in which the data voltages at the pixels surrounded by the dotted lines in FIGS. 8 to 11 are supplied to the data lines until the respective selection signals are activated are longer than the periods from the start of the periods in which the data voltages at the pixels that are not surrounded by the dotted lines are supplied to the data lines until the selection signals are activated.

6. Electro-optical Apparatus

Figure 12:
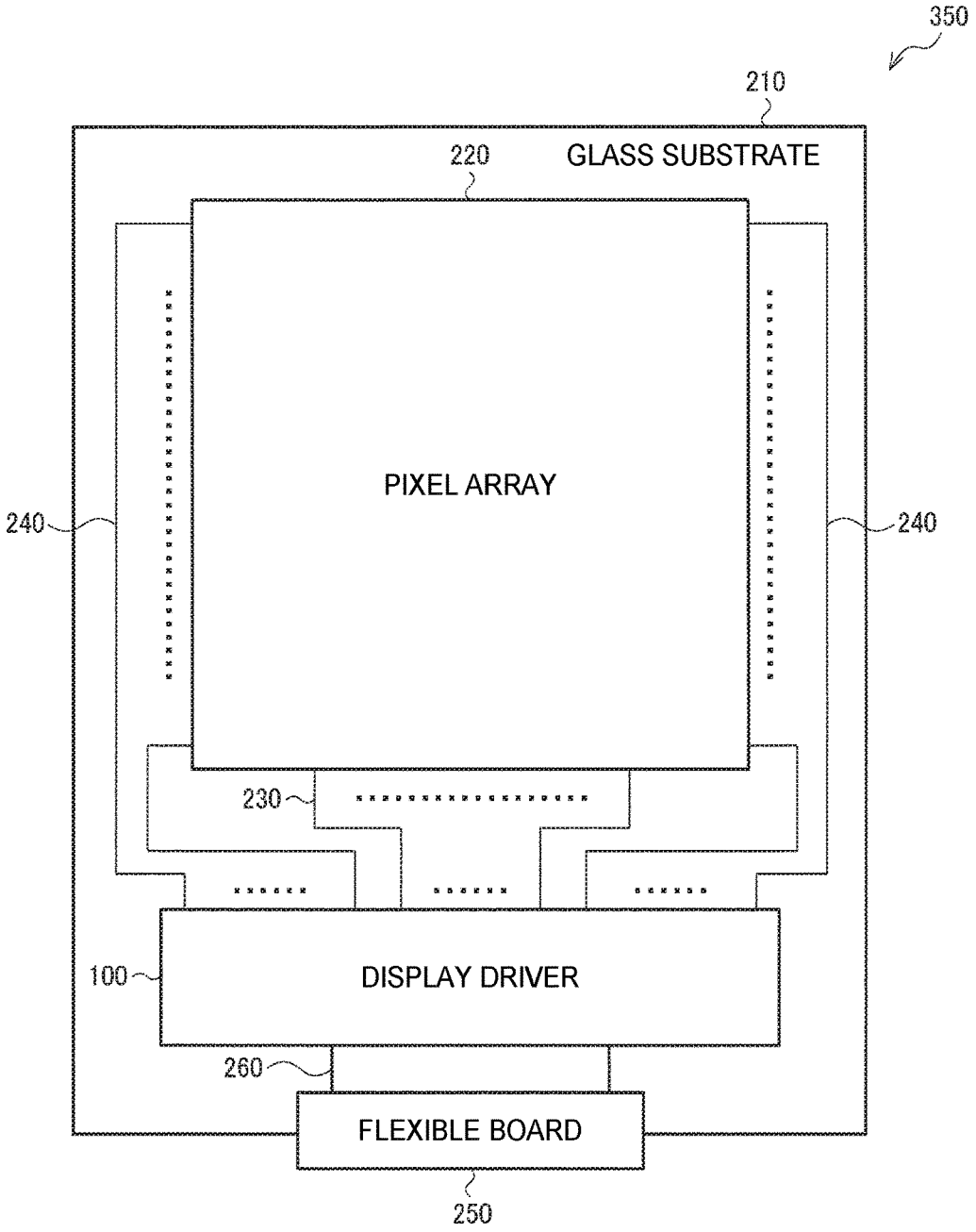
FIG. 12 shows an exemplary configuration of an electro-optical apparatus.

FIG. 12 shows an exemplary configuration of an electro-optical apparatus 350, which includes the display driver 100 (scan line drive circuit 10) according to this embodiment.

The electro-optical apparatus 350 includes a glass substrate 210, a pixel array 220 that is formed on the glass substrate 210, the display driver 100 that is mounted on the glass substrate 210, an interconnect group 230 that connects the display driver 100 to the data lines in the pixel array 220, an interconnect group 240 that connects the display driver 100 to the scan lines in the pixel array 220, a flexible board 250 that is connected to a display controller 300, and an interconnect group 260 that connects the flexible board 250 to the display driver 100. The interconnect group 230, interconnect group 240, and interconnect group 260 are formed with a transparent electrode (ITO: Indium Tin Oxide) or the like on the glass substrate 210. The pixel array 220 includes the pixels, data lines, and scan lines, and the glass substrate 210 and pixel array 220 correspond to the display panel 40. Note that the electro-optical apparatus may further include a substrate connected to the flexible board 250, and the display controller 300 mounted on this substrate. Although FIG. 12 illustrates an example in the case where the scan line drive circuit 10 is included in the display driver 100, the invention is not limited thereto. The scan line drive circuit 10 may be provided (formed or mounted) on the glass substrate 210 separately from the display driver 100.

7. Electronic Device

Figure 13:
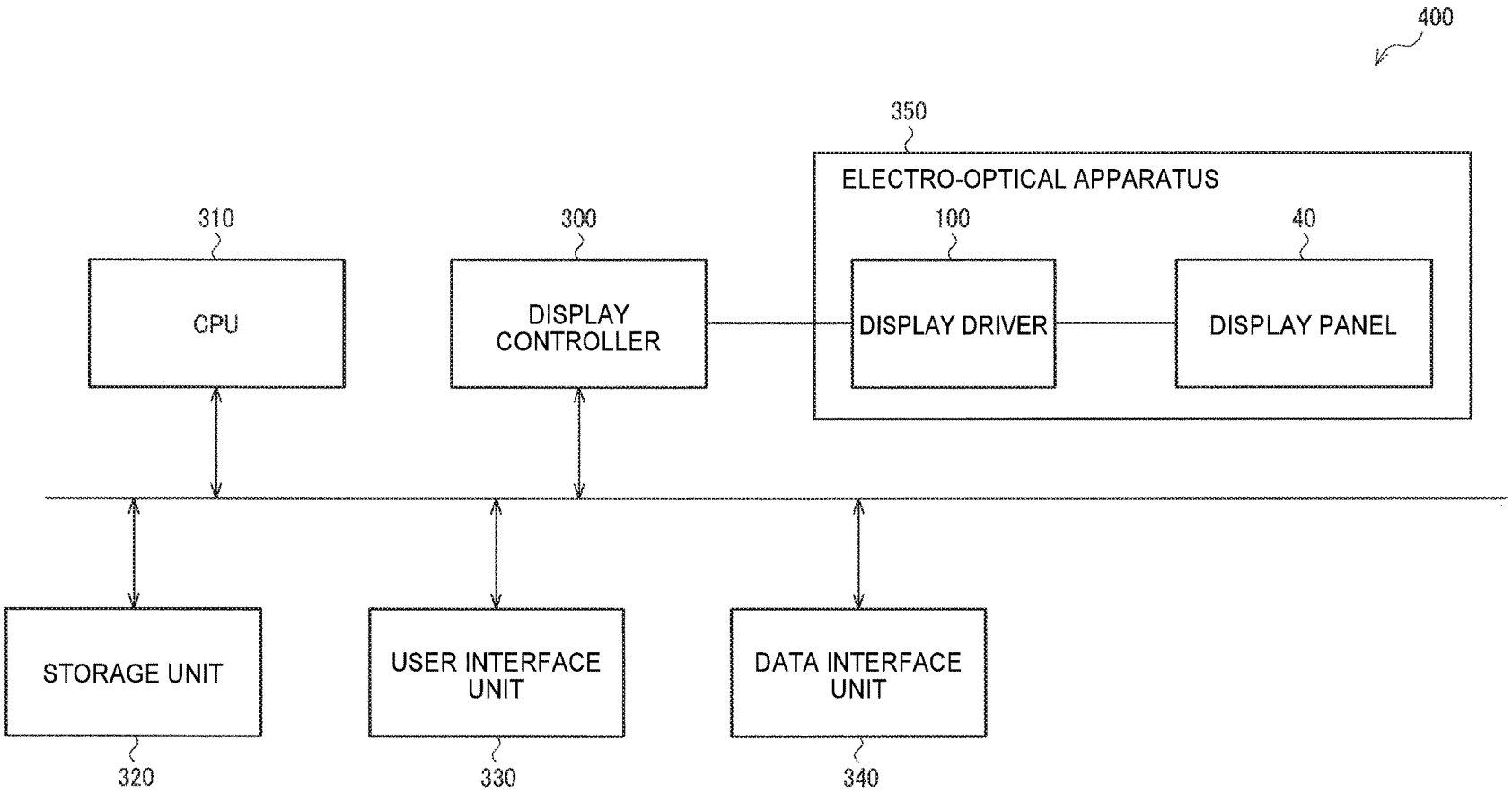
FIG. 13 shows an exemplary configuration of an electronic device.

FIG. 13 shows an exemplary configuration of an electronic device 400 that includes the display driver 100 (scan line drive circuit 10) according to this embodiment. Conceivable electronic devices according to this embodiment include various electronic devices that contain a display device, such as an in-vehicle display device (e.g. a meter panel), a monitor, a display, a single panel projector, a television apparatus, an information processing apparatus (computer), a portable information terminal, a car navigation system, a portable game terminal, a DLP (Digital Light Processing) apparatus, and a printer.

The electronic device 400 includes the electro-optical apparatus 350, a CPU 310 (processor in a wide sense), the display controller 300, a storage unit 320 (memory, storage device), a user interface unit 330 (user interface circuit), and a data interface unit 340 (data interface circuit). The electro-optical apparatus 350 includes the display driver 100 and the display panel 40. Note that functions of the display controller 300 may be implemented by the CPU 310, and the display controller 300 may be omitted. A configuration may be employed in which the display driver 100 and the display panel 40 are not integrally configured as the electro-optical apparatus 350 and are incorporated as individual constituent elements in the electronic device.

The user interface unit 330 is an interface unit that accepts various operations from a user. For example, the user interface unit 330 is constituted by buttons, a mouse, a keyboard, a touch panel attached to the display panel 40, or the like. The data interface unit 340 is an interface unit that inputs and outputs image data and control data. For example, the data interface unit 340 is a wired communication interface such as a USB, or a wireless communication interface such as a wireless LAN. The storage unit 320 stores image data that is input from the data interface unit 340. Otherwise, the storage unit 320 functions as a working memory for the CPU 310 and the display controller 300. The CPU 310 performs control processing for each part of the electronic device and various kinds of data processing. The display controller 300 performs control processing for the display driver 100. For example, the display controller 300 converts image data transferred from the data interface unit 340 and the storage unit 320 via the CPU 310 into data in a format that can be accepted by the display driver 100, and outputs the converted image data to the display driver 100. The display driver 100 drives the display panel 40 based on the image data transferred from the display controller 300.

For example, if the electronic device 400 is an in-vehicle display device, the CPU 310, the storage unit 320, and the like correspond to ECUs (Electronic Control Units). Various kinds of information (e.g. information such as vehicle speed, the amount of remaining fuel, room temperature, and date and time) processed by these ECUs are transferred to the display controller 300 and the electro-optical apparatus 350, and are displayed on the display panel 40. Note that the in-vehicle display device and the ECUs may be separate bodies, and the in-vehicle display device may not include the CPU 310, the storage unit 320, and the like.

Note that although this embodiment has been described above in detail, those skilled in the art would readily understand that the embodiment is able to be modified in many ways without substantially departing from new matter and the effects of the invention. Accordingly, all such modifications are encompassed in the scope of the invention. For example, a term that is used with a different term having a broader or the same meaning at least once in the specification or the drawings may be replaced with this different term in any part of the specification or the drawings. All combinations of this embodiment and the modifications are also encompassed in the scope of the invention. The configurations, operations, and the like of the scan line drive circuit, display driver, display panel, electro-optical apparatus, electronic device, and the like are not limited to those described in this embodiment, and may be modified in various manners.

What is claimed is:

1. A scan line drive circuit that outputs a selection signal to select a scan line in a display panel, wherein the scan line drive circuit is configured so that:

a period in which a data voltage after being subjected to inversion of a polarity from a polarity in an immediately preceding pixel driving period is supplied to a data line in the display panel is a first period;

a period in which a data voltage after not being subjected to inversion of a polarity from the polarity in the immediately preceding pixel driving period is supplied to the data line is a second period;

a first wait period is a period from a start of the first period until the selection signal is activated to select a scan line to write the data voltage that has been subjected to the inversion of the polarity;

a second wait period is a period from a start of the second period until the selection signal is activated to select a scan line to write the data voltage that has not been subjected to the inversion of the polarity, such that:

every time a data voltage having an inverted polarity from the polarity in the immediately preceding pixel driving period is driven to a pixel, the first wait period precedes the activation of the selection signal; and every time a data voltage having a same polarity as the polarity in the immediately preceding pixel driving period is driven to a pixel, the second wait period precedes the activation of the selection signal; and the first wait period is longer than the second wait period, wherein:

the display panel has a first pixel group to be selected by a first scan line and a second pixel group to be selected by a second scan line, the first scan line and the second scan line being provided corresponding to a first display line; and the data line is shared by a pixel in the first pixel group and a pixel in the second pixel group.

2. The scan line drive circuit according to claim 1, wherein:

a length of a first selection period in which the selection signal is maintained in an active state within the first period is same as a length of a second selection period in which the selection signal is maintained in the active state within the second period.

3. The scan line drive circuit according to claim 1, wherein:

the first period starts after the polarity of the data voltage has been inverted (i) due to switching from a first common voltage, which is higher than the data voltage, to a second common voltage, which is lower than the data voltage, or (ii) due to switching from the second common voltage to the first common voltage.

4. The scan line drive circuit according to claim 1, wherein:

the selection signal to select the first scan line is activated to select the first pixel group (i) in a third period in which a data voltage having a same polarity as a polarity of a data voltage used to drive the first pixel group is supplied to the data line, and (ii) in a fourth period in which the data voltage used to drive the first pixel group is supplied to the data line;

the selection signal to select the second scan line is activated to select the second pixel group (i) in a fifth period in which a data voltage having a same polarity as a polarity of a data voltage used to drive the second pixel group is supplied to the data line, and (ii) in a sixth period in which the data voltage used to drive the second pixel group is supplied to the data line; and if the fourth period or the sixth period is a period after a polarity of a respective data voltage has been inverted, a period from a start of the fourth period or the sixth period after the polarity of the respective data voltage has been inverted until the selection signal is activated is longer than a period from a start of a period, in which the respective data voltage after not being subjected to inversion of the polarity thereof is supplied to the data line, until the selection signal is activated.

5. The scan line drive circuit according to claim 4, wherein:

if the third period or the fifth period is a period after the polarity of the respective data voltage has been inverted, a period from a start of the third period or the fifth period after the polarity of the respective data voltage has been inverted until the selection signal is activated is longer than a period from a start of a period, in which the respective data voltage after not being subjected to inversion of the polarity thereof is supplied to the data line, until the selection signal is activated.

6. A display driver comprising:

the scan line drive circuit according to claim 1; and a data line drive circuit that drives the data line.

7. An electro-optical apparatus comprising:

the scan line drive circuit according to claim 1; and the display panel.

8. An electronic device comprising the scan line drive circuit according to claim 1.

9. A scan line drive circuit that outputs a selection signal to select a scan line in a display panel, wherein the scan line drive circuit is configured so that:

a period in which a data voltage after being subjected to inversion of a polarity from a polarity in an immediately preceding pixel driving period is supplied to a data line in the display panel is a first period;

a period in which a data voltage after not being subjected to inversion of a polarity from the polarity in the immediately preceding pixel driving period is supplied to the data line is a second period;

a first wait period is a period from a start of the first period until the selection signal is activated to select a scan line to write the data voltage that has been subjected to the inversion of the polarity;

a second wait period is a period from a start of the second period until the selection signal is activated to select a scan line to write the data voltage that has not been subjected to the inversion of the polarity, such that:

every time a data voltage having an inverted polarity from the polarity in the immediately preceding pixel driving period is driven to a pixel, the first wait period precedes the activation of the selection signal; and every time a data voltage having a same polarity as the polarity in the immediately preceding pixel driving period is driven to a pixel, the second wait period precedes the activation of the selection signal; and the first wait period is longer than the second wait period, wherein:

the display panel has a pixel on a first display line to be selected by a first scan line, a pixel on a second display line to be selected by a second scan line, and a pixel on a third display line to be selected by a third scan line; and the pixel on the first display line, the pixel on the second display line, and the pixel on the third display line are pixels having colors different from one another.

10. The scan line drive circuit according to claim 9, wherein:

a length of a first selection period in which the selection signal is maintained in an active state within the first period is same as a length of a second selection period in which the selection signal is maintained in the active state within the second period.

11. The scan line drive circuit according to claim 9, wherein:

the first period starts after the polarity of the data voltage has been inverted (i) due to switching from a first common voltage, which is higher than the data voltage, to a second common voltage, which is lower than the data voltage, or (ii) due to switching from the second common voltage to the first common voltage.

12. The scan line drive circuit according to claim 9, wherein:

the selection signal to select the first scan line is activated (i) in a third period in which a data voltage having a same polarity as a polarity of a data voltage used to drive the first pixel group is supplied to the data line, and (ii) in a fourth period in which the data voltage used to drive the first pixel group is supplied to the data line;

the selection signal to select the second scan line is activated (i) in a fifth period in which a data voltage having a same polarity as a polarity of a data voltage used to drive the second pixel group is supplied to the data line, and (ii) in a sixth period in which the data voltage used to drive the second pixel group is supplied to the data line; and if the fourth period or the sixth period is a period after a polarity of a respective data voltage has been inverted, a period from a start of the fourth period or the sixth period after the polarity of the respective data voltage has been inverted until the selection signal is activated is longer than a period from a start of a period, in which the respective data voltage after not being subjected to inversion of the polarity thereof is supplied to the data line, until the selection signal is activated.

13. The scan line drive circuit according to claim 12, wherein:

if the third period or the fifth period is a period after the polarity of the respective data voltage has been inverted, a period from a start of the third period or the fifth period after the polarity of the respective data voltage has been inverted until the selection signal is activated is longer than a period from a start of a period, in which the respective data voltage after not being subjected to inversion of the polarity thereof is supplied to the data line, until the selection signal is activated.

14. A display driver comprising:

the scan line drive circuit according to claim 9; and a data line drive circuit that drives the data line.

15. An electro-optical apparatus comprising:

the scan line drive circuit according to claim 9; and the display panel.

16. An electronic device comprising the scan line drive circuit according to claim 9.

17. A driving method for outputting a selection signal to select a scan line in a display panel, comprising:

outputting the selection signal so that:

a period in which a data voltage after being subjected to inversion of a polarity from a polarity in an immediately preceding pixel driving period is supplied to a data line in the display panel is a first period;

a period in which a data voltage after not being subjected to inversion of a polarity from the polarity in the immediately preceding pixel driving period is supplied to the data line is a second period;

a first wait period is a period from a start of the first period until the selection signal is activated to select a scan line to write the data voltage that has been subjected to the inversion of the polarity;

a second wait period is a period from a start of the second period until the selection signal is activated to select a scan line to write the data voltage that has not been subjected to the inversion of the polarity, such that:

every time a data voltage having an inverted polarity from the polarity in the immediately preceding pixel driving period is driven to a pixel, the first wait period precedes the activation of the selection signal; and every time a data voltage having a same polarity as the polarity in the immediately preceding pixel driving period is driven to a pixel, the second wait period precedes the activation of the selection signal; and the first wait period is longer than the second wait period, wherein:

the display panel has a first pixel group to be selected by a first scan line and a second pixel group to be selected by a second scan line, the first scan line and the second scan line being provided corresponding to a first display line; and the data line is shared by a pixel in the first pixel group and a pixel in the second pixel group.

* * * * *